US006209235B1

(12) United States Patent
Schiltz

(10) Patent No.: US 6,209,235 B1
(45) Date of Patent: Apr. 3, 2001

(54) SNOW BLOCKER ATTACHMENT FOR A DEVICE USED TO MOVE SNOW

(76) Inventor: Boyd D. Schiltz, R.R. 2, Box 88, Wessington, SD (US) 57381

( * ) Notice: Subject to any disclaimer, the term of this patent is extended or adjusted under 35 U.S.C. 154(b) by 0 days.

(21) Appl. No.: 09/303,446

(22) Filed: May 3, 1999

(51) Int. Cl.[7] ..... E02F 3/96

(52) U.S. Cl. ..... 37/403; 37/285; 37/265; 37/280

(58) Field of Search ..... 37/264, 265, 266, 37/274, 278, 280, 281, 284, 285, 403, 407, 903; 294/55, 54.5

(56) References Cited

U.S. PATENT DOCUMENTS

| | | | | |
|---|---|---|---|---|
| 2,256,953 | * | 9/1941 | Smith | 37/280 |
| 2,388,985 | * | 11/1945 | Martin | 37/283 |
| 3,279,104 | * | 10/1966 | Wandscheer et al. | 37/280 |
| 3,430,706 | * | 3/1969 | Marron | 172/815 |
| 4,145,825 | * | 3/1979 | Bertolino | 37/280 |
| 5,367,796 | * | 11/1994 | Bowers et al. | 37/410 |
| 5,377,766 | * | 1/1995 | Klinger | 172/782 |
| 5,522,629 | * | 6/1996 | Loo | 294/51 |
| 5,596,825 | * | 1/1997 | Von Schalscha | 37/407 |
| 5,669,163 | * | 9/1997 | Winter | 37/284 |
| 5,758,728 | * | 6/1998 | Ragule | 172/815 |
| 5,819,444 | * | 10/1998 | Desmarais | 37/281 |
| 5,903,986 | * | 5/1999 | Parker | 37/281 |

* cited by examiner

*Primary Examiner*—Victor Batson
(74) *Attorney, Agent, or Firm*—David A. Lingbeck

(57) ABSTRACT

A snow blocker attachment for a device used to move snow including a snow blocker having a wall member with a hole through central portion and near a bottom edge thereof, a frame to strengthen the wall, and at least one brace member formed about the hole. The snow blocker is pivotally mounted about a horizontal axis and upon a hub member which is securely attached to a bracket member which is securely attached to the snow moving device. A stop member is also securely attached to the bracket member and is used to limit the rotation of the snow blocker. In a second embodiment, the snow blocker attachment includes three plate-like members, two of which are securely attached along one side of the snow moving device and the other of which is attached across the top of the snow moving device. Instead of snow spilling over both sides of the snow moving device, the snow blocker attachment limits the snow spilling to just one side.

18 Claims, 3 Drawing Sheets

SNOW BLOCKER ATTACHMENT FOR A DEVICE USED TO MOVE SNOW

BACKGROUND OF THE INVENTION

This invention relates to a snow blocker attachment for a device used to move snow for substantially preventing snow from spilling out from one of the sides of the snow moving device.

Skid loaders and front end loaders have buckets which have equal and opposite side walls and which are generally used to pick up and carry objects and which have also been used to move snow on roads, driveways, and parking lots. Snow which is gathered on parking surfaces or on sidewalks or driveways is best moved by pushing the snow to one end thereof. Unfortunately, when a user uses a skid loader, front end loader or even a scoop or shovel, the bucket or shovel has a limited capacity to hold the snow, and as the user pushes the snow with the bucket or scoop, the snow spills around both sides of the bucket or scoop making the process of moving the snow more time consuming because the user has to go over the snow which spilled around the sides. None of the prior art actually solves this problem.

One known prior art is a PLOW WITH ARTICULATING BLADE, U.S. Pat. No. 5,758,728, issued on Jun. 2, 1998 and invented by Edward J. Ragule and comprising a gate member that is hinged to the main blade, a drive means for moving the first gate member, a second gate member mounted to the main blade, and a linking means for moving the second gate member relative to the first gate member.

Another known prior art is a SNOW RETAINING GATE FOR FRONT END DIAGONAL PLOW, U.S. Pat. No. 3,407,519, issued on Oct. 29, 1968 and invented by A. D. Batko and comprising a gate, means for pivotally mounting the gate to the blade, and a power means for moving the gate between an operative position and an inoperative position.

Another known prior art is a SNOW WING GATE, U.S. Pat. No. 4,077,139, issued on Mar. 7, 1978 and invented by Leroy W. Fagervold et al and comprising a frame, bracket means mounted on the frame for securing the frame to the plow blade, a gate member pivotally mounted to the frame, and actuating means for pivoting the gate member.

None of the prior art describes a snow blocking attachment of the present invention.

SUMMARY OF THE INVENTION

The present invention relates to a snow blocker attachment for a device used to move snow comprising a snow blocking means rotatably mounted upon a mounting means which is securely attached to one side of the snow moving device. The snow blocking means includes a wall having a hole therethrough and being removably balanced upon a hub member which is securely attached to a bracket member which is securely fastened to the snow moving device. Another embodiment includes three plate-like members, two of which are securely attached to one side of the snow moving device and the third of which is securely attached along a top of the snow moving device.

One objective of the present invention is to provide a snow blocker attachment for a device used to move snow which substantially reduces the amount of time needed to clear a surface with snow on it.

Another objective of the present invention is to provide a snow blocker attachment for a device used to move snow which can be easily and quickly mounted to the snow moving device without having to attach hoses and other power means as found in the prior art.

Yet, another objective of the present invention is to provide a snow blocker attachment for a device used to move snow which can be effectively used when the snow moving device is moving either forward or backward.

Further objectives and advantages of the present invention will become apparent as the description proceeds and when taken in conjunction with the accompanying drawings wherein:

DETAILED DESCRIPTION OF THE INVENTION

Figure 2:
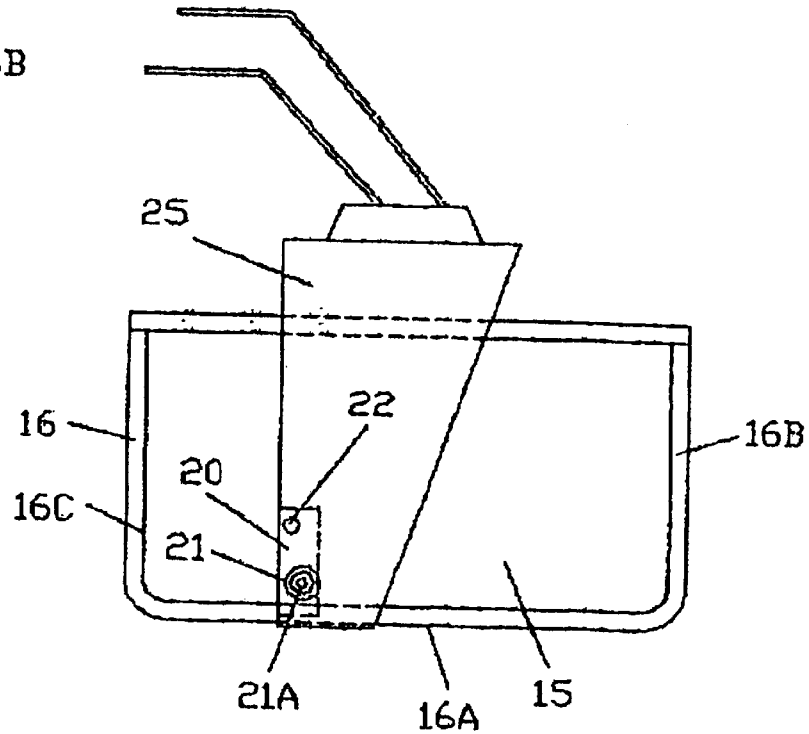
FIG. 2 is a side view of the snow blocker attachment mounted to a bucket of loader used to move snow while backing up.
Figure 1:
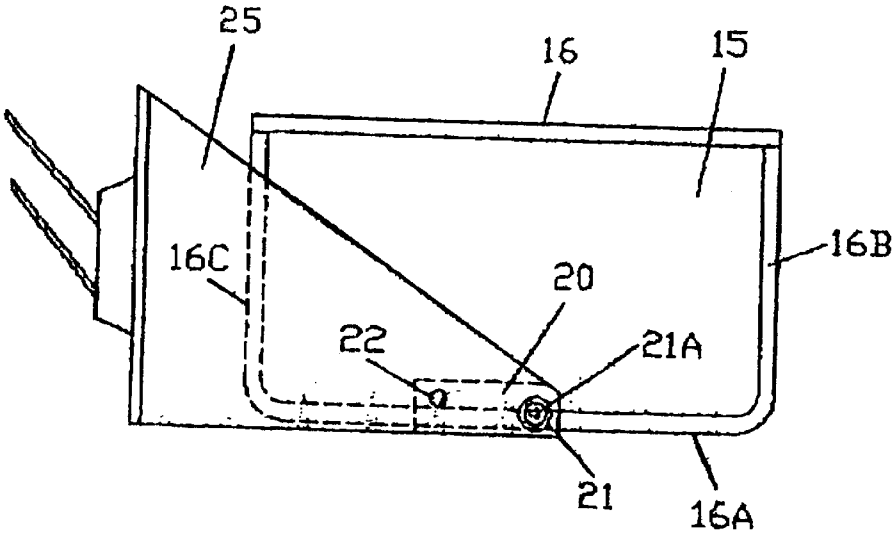
FIG. 1 is a side view of the snow blocker attachment mounted to a bucket of a loader used to move snow.
Figure 3:
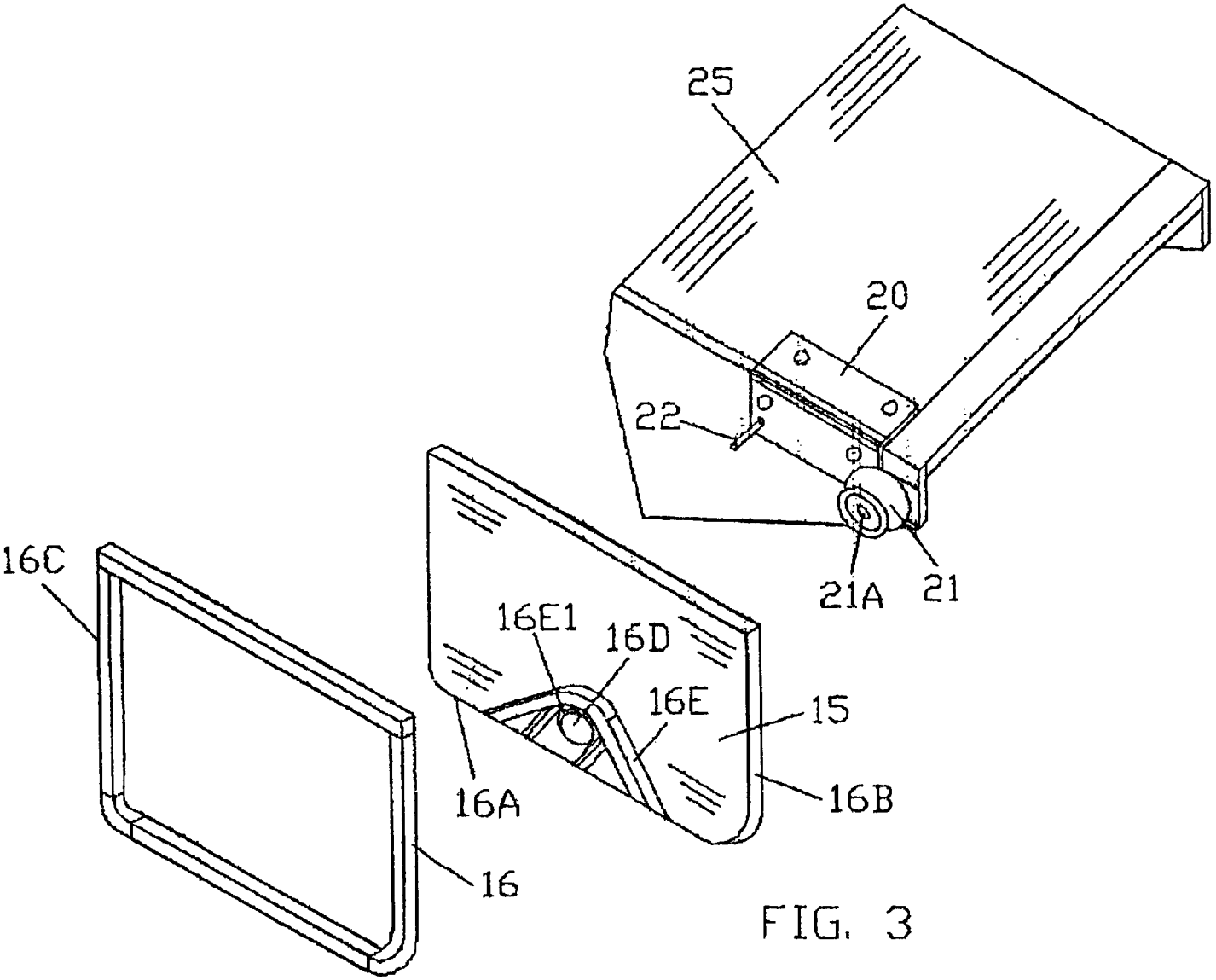
FIG. 3 is an exploded view of the snow blocker attachment.
Figure 4:
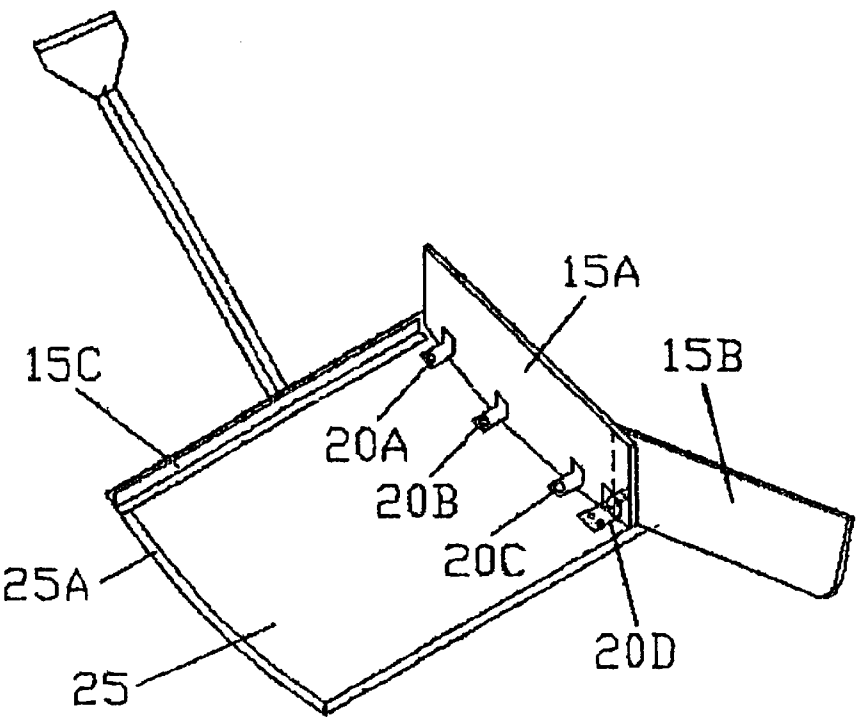
FIG. 4 is a top perspective view of a second embodiment of the snow blocker attachment mounted to a snow shovel.
Figure 5:
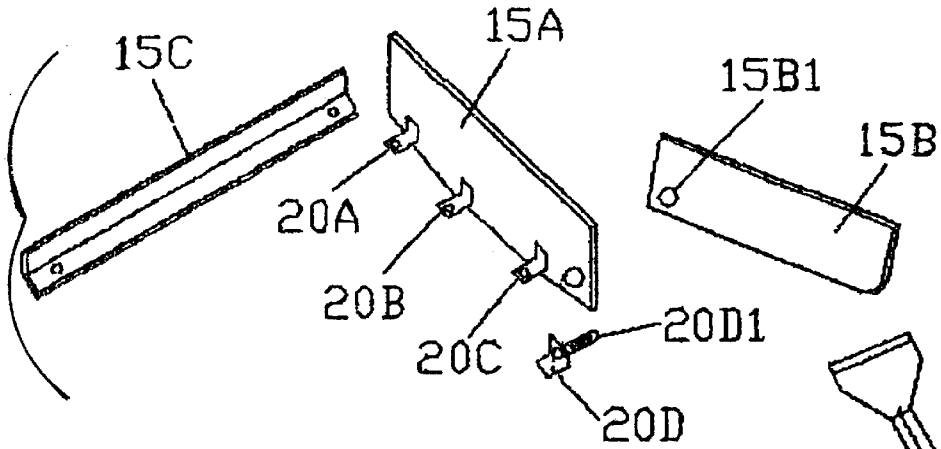
FIG. 5 is an exploded perspective view of the second embodiment of the snow blocker attachment.

Referring to the drawings in FIGS. 1–5, in particular, a snow blocker attachment for a device used to move snow comprises a snow blocking means which includes a wall member being generally rectangular, having a bottom edge, a front portion and a rear portion and having a hole 16D centrally disposed therethrough near the bottom edge 16A thereof, and which further includes a tubular frame 16 which is securely attached or welded along the perimeter and on one side of the wall member 15 to stabilize and strengthen the wall member 15. Further, the snow blocking means includes a wall support means comprising at least one brace member 16E which is fixedly and conventionally attached about the hole 16D and to the wall member 15 and to a portion of the frame 16 and forming an opening 16E1 therethrough, which is in alignment with and has a dimension generally that of the hole 16D through the wall member 15 for strengthening the wall member 15 when it is mounted to the snow moving device 25. The means used to mount the snow blocking means to the snow moving device 25 includes an angular mounting bracket 20 which is securely and conventionally attached along a side and bottom and near the front end of the bucket of the snow moving device 20, and further includes a hub member 21 which is essentially a cylindrical structure having a threaded bore 21A extending in one end thereof and capable of being rotatably received through the opening 16E1 and the hole 16D in the wall member 15, with the other end of the hub member 21 being securely attached to the bracket member 20 near the front end of the bucket, and also includes a stop member 22 which extends outwardly of the bracket member 20 and is in contactable relationship to the frame 16 when the snow blocking means is mounted to the snow moving device 25.

In use, the snow blocking means is rotatably mounted upon the hub member 21 which extends through the opening 16E1 and the hole 16D in the wall member 15, and is secured upon the hub member 21 with a conventional fastener (not shown) which includes a washer and a bolt which is threaded into the bore 21A of the hub member 21. The snow blocking means is essentially balanced upon the hub member 21 such that when the bucket 25 is lifted off the surface of the ground and tilted, the snow blocking means will not flip over either forwardly or rearwardly but will generally retain its position relative to the ground with the bottom edge 16A of the wall member 15 facing the ground. The location of the hole 16D through the wall member 15 is important for balancing the snow blocking means upon the hub member 21. When the snow blocking means is mounted upon the hub member 21, the snow blocking means is disposed vertically and is generally perpendicular to the bottom surface of the bucket 25 with a front portion 16B of the snow blocking means extending outwardly and forwardly of the front end of the bucket 25 so that as snow is being pushed, the snow blocking means will prevent the snow from spilling over the side where the snow blocking means is mounted and will force the snow to spill over the other side of the bucket 25. Unlike any of the prior art, the snow blocking attachment is also useful when the snow moving device is moving in a reverse direction and with the bucket 25 being tilted up on end with the bottom surface of the bucket 25 being vertically disposed relative to the ground as shown in FIG. 2. When the bucket 25 is tilted up on end, the snow blocking means rotates relative to the bucket 25 and maintains its position but with a rear portion 16C of the snow blocking means now extending outwardly and rearwardly from the bucket 25 such that as the snow moving device is used to move snow in a reverse direction, the snow blocking means will also prevent snow from spilling over on the side where the snow blocking means is mounted.

In a second embodiment, the snow blocking attachment is securely attached to a snow moving device such as a snow shovel 25 and includes a first plate-like member 15A being securely attached along and extending outwardly from one side of the snow moving surface 25A or blade of the shovel, and further includes a second plate-like member 15B which has an and pivotally attached on the same side as the first plate-like member 15A and which partially overlaps a front portion of the first plate-like member 15A and extends forwardly and perpendicularly of the snow moving surface 25A of the shovel 25 and which is generally parallel to and in alignment with the first plate-like member 15A, and also includes a third plate-like member 15C which is angled laterally and is securely and conventionally attached along the top of the snow moving surface 25A of the snow moving device 25 and generally extends outwardly and perpendicularly of the snow moving surface 25A to essentially prevent snow from spilling over the top of the shovel 25 as the snow is being moved by the shovel 25. The means used to mount the first plate-like member 15A and the second plate-like member 15B to the snow moving device 25 includes a plurality of tab members 20A–C which are spaced apart and are integrally attached to and extends outwardly from a bottom edge of the first plate-like member 15A and are conventionally attached along one side of the snow moving surface 25A of the snow moving device 25, and also includes a bracket member 20D which is securely and conventionally attached near a front corner of the snow moving surface 25A. The second plate-like member 15B has a hole 15B1 near a back end thereof and is pivotally mounted to the bracket member 20D with a threaded fastener 20D1 which is inserted through the hole 15B1 in the second plate-like member 15B and threaded into the bracket member 20D.

In use, the front portion of the second plate-like member 15B is in contactable relationship with the ground as it rides upon the ground while the snow moving device 25 is moved across the ground. Instead of the snow spilling over both sides of the snow shovel 25, the snow blocking means substantially prevents the snow from spilling over on the side and top to which the plate-like members 15A–C are attached and force the snow to spill over on the other side of the shovel 25. The snow blocking attachment for both embodiments virtually eliminates the number of passes needed over the ground surface to substantially remove the snow therefrom.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A snow blocker attachment for a device used to move snow comprising:

a snow blocking member being adapted to be pivotally mounted to one side of the snow moving device and having a portion which extends forwardly of the snow moving device, said snow blocking member including a wall member having a bottom edge and a hole extending through said wall member near said bottom edge; a frame securely attached along a perimeter of said wall member for strengthening said wall member; and a wall support means securely attached about said hole; and a means for mounting said snow blocking member to the snow moving device.

2. A snow blocker attachment for a device used to move snow as described in claim 1, wherein said frame is a tubular structure.

3. A snow blocker attachment for a device used to move snow as described in claim 1, wherein said hole is centrally disposed near said bottom edge of said wall member for substantially balancing said snow blocking means when mounted upon the snow moving device.

4. A snow blocker attachment for a device used to move snow as described in claim 3, wherein said wall support means includes at least one brace member which is securely attached to said frame and to said wall member and is disposed about said hole.

5. A snow blocker attachment for a device used to move snow as described in claim 4, wherein said mounting means includes a bracket member which is securely attached to a side wall of the snow moving device; a hub member which is securely attached to said bracket member and extends outwardly therefrom for supporting said snow blocking means; and a stop member which is securely attached to said bracket member for substantially preventing said snow blocking means from pivoting forwardly and downwardly about a horizontal axis.

6. A snow blocker attachment for a device used to move snow as described in claim 5, wherein said hub member is a cylindrical structure having a threaded bore extending through an exposed end thereof.

7. A snow blocker attachment for a device used to move snow as described in claim 6, wherein said stop member is spaced rearwardly from said hub member relative to the snow moving device and extends outwardly from said bracket member and is in contactable relationship with said frame.

8. A snow blocker attachment for a device used to move snow as described in claim 7, wherein said hub member is disposed near a front end of the snow moving device, said hole being adapted to receive said hub member therethrough, said snow blocking means being pivotally and removably fastened upon said hub member and being pivotable about a horizontal axis.

9. A snow blocker attachment for a device used to move snow as described in claim 8, wherein said snow blocking means is substantially balanced upon said hub member such that when the snow moving device is elevated above a ground surface, said bottom edge of said wall member continues to face the ground surface.

10. A snow blocker attachment for a device used to move snow as described in claim 1 wherein said wall member is adapted to not only extend forwardly of the snow moving device but also to extend rearwardly of the snow moving device when the snow moving device is tilted on end to allow the use of said snow blocker attachment when the snow moving device is moving either forwardly or backwardly.

11. A snow blocker attachment for a device used to move snow comprising:

a snow blocking member being adapted to be pivotally mounted to one side of the snow moving device and having a portion which extends forwardly of the snow moving device, said snow blocking member including a first wall section and a second wall section both of which are adapted to be securely attached to one side of a snow moving surface of the snow moving device, and further including a third wall section which is securely attached along a top of a snow moving surface of the snow moving device to prevent the snow from spilling over the top of the snow moving surface during the use thereof; and a means for mounting said snow blocking member to the snow moving device.

12. A snow blocker attachment for a device used to move snow as described in claim 11, wherein said first plate-like member extends outwardly and perpendicularly from the snow moving surface of the snow moving device.

13. A snow blocker attachment for a device used to move snow as described in claim 12, wherein said second plate-like member extends forwardly of the snow moving surface and is generally aligned with said first plate-like member with a bottom edge of said second plate-like member being in contactable relationship with a ground surface during the use of said snow blocker attachment.

14. A snow blocker attachment for a device used to move snow as described in claim 13, wherein said first and second plate-like members are vertically disposed relative to a ground surface during the use of said snow blocker attachment.

15. A snow blocker attachment for a device used to move snow as described in claim 11, wherein said third plate-like member extends outwardly and perpendicularly from the snow moving surface of the snow moving device.

16. A snow blocker attachment for a device used to move snow as described in claim 11, wherein said mounting means includes a plurality of tab members integrally attached to, extending from and spaced along said first plate-like member; and a bracket member which is securely fastened to the snow moving surface of the snow moving device.

17. A snow blocker attachment for a device used to move snow as described in claim 16, wherein said plurality of tab members are removably and securely fastened along an edge of the snow moving surface of the snow moving device.

18. A snow blocker attachment for a device used to move snow as described in claim 16, wherein said second plate-like member is pivotally mounted to said bracket member.

* * * * *